US007240384B2

(12) United States Patent
DuDonis

(10) Patent No.: US 7,240,384 B2
(45) Date of Patent: Jul. 10, 2007

(54) METHOD OF REPOSITIONING IMMOBILE PATIENT IN BED USING PATIENT POSITIONING AID

(75) Inventor: Matthew DuDonis, Ellicott City, MD (US)

(73) Assignee: Intensive Therapeutics, Inc., Ellicott City, MD (US)

( * ) Notice: Subject to any disclaimer, the term of this patent is extended or adjusted under 35 U.S.C. 154(b) by 0 days.

(21) Appl. No.: 10/872,011

(22) Filed: Jun. 18, 2004

(65) Prior Publication Data

US 2005/0005358 A1 Jan. 13, 2005

Related U.S. Application Data

(60) Provisional application No. 60/485,584, filed on Jul. 8, 2003.

(51) Int. Cl.
*A61G 7/057* (2006.01)
*A47C 16/00* (2006.01)
*A47C 20/02* (2006.01)

(52) U.S. Cl. ..... 5/633; 5/655.9; 5/925; 5/926

(58) Field of Classification Search ..... 5/655, 5/655.9, 633, 632, 636, 646, 648, 652, 630, 5/925, 926
See application file for complete search history.

(56) References Cited

U.S. PATENT DOCUMENTS 1,890,358 A * 12/1932 Barcalo ..... 5/640
1,935,485 A * 11/1933 Reynolds ..... 5/633
2,460,452 A * 2/1949 Hampton ..... 5/490
3,148,387 A * 9/1964 Sarnie, Jr. et al. ..... 5/632
3,389,411 A 6/1968 Emery
T903,027 I4 * 10/1972 McBrayer ..... 521/117
3,811,140 A 5/1974 Burpo
3,842,977 A 10/1974 Hollander
3,938,205 A 2/1976 Spann
4,054,204 A 10/1977 Keeton
4,197,603 A * 4/1980 Greenhawk, Sr. ..... 5/630
4,214,326 A 7/1980 Spann
4,233,700 A 11/1980 Spann
D266,549 S * 10/1982 Lund, III ..... D6/601
4,504,990 A * 3/1985 Scales et al. ..... 5/698
4,711,067 A 12/1987 Magni
4,733,836 A * 3/1988 Barnes ..... 248/106
4,901,384 A * 2/1990 Eary ..... 5/632
5,095,569 A 3/1992 Glenn
5,269,323 A * 12/1993 Krouskop ..... 5/632
5,272,780 A * 12/1993 Clute ..... 5/655
5,341,531 A * 8/1994 Straub et al. ..... 5/655

(Continued)

*Primary Examiner*—Carl D. Friedman
*Assistant Examiner*—Gay Ann Spahn
(74) *Attorney, Agent, or Firm*—William S. Ramsey

(57) ABSTRACT

The patient positioning aid assists a caregiver in rotating and positioning immobile patients. Such patients require periodic movement to prevent the development of ulcers. Conventional methods use rolled blankets or pillows to support such patients. Such improvizations are often crushed by the patients, especially by bariatric patients. The present invention has a strong resilient foam core which resists compression by a patient, yet also has a yielding surface foam layer which avoids trauma to the patient's skin. The cover is removable for cleaning, waterproof, and utilizes an anti-slip, high friction coating on the bottom which resists sliding on the bed. In addition, handles on the caregiver side of the aid assist in the maneuvering of the aid to position it properly.

1 Claim, 8 Drawing Sheets

U.S. PATENT DOCUMENTS 5,347,669 A * 9/1994 Neviaser et al. ..... 5/655
5,359,739 A 11/1994 Rains et al.
5,450,640 A * 9/1995 Patton et al. ..... 5/655
5,461,741 A * 10/1995 Graebe ..... 5/654
5,528,785 A * 6/1996 Petrus ..... 5/655
5,530,974 A * 7/1996 Rains et al. ..... 5/81.1 T
5,575,027 A * 11/1996 Mueller ..... 5/621
5,664,271 A * 9/1997 Bellavance ..... 5/632
5,815,863 A * 10/1998 Dolisi ..... 5/632
5,878,551 A 3/1999 Curley et al.
5,906,018 A * 5/1999 Kidwell ..... 5/656
5,953,749 A * 9/1999 Backs ..... 2/1
6,009,873 A * 1/2000 Neviaser ..... 128/845
6,042,184 A * 3/2000 Kofoed ..... 297/391
6,067,679 A * 5/2000 Rice ..... 5/630
6,097,294 A * 8/2000 Hilton ..... 340/573.1
6,154,900 A 12/2000 Shaw
6,202,239 B1 * 3/2001 Ward et al. ..... 5/727
6,292,964 B1 9/2001 Rose et al.
6,481,030 B2 * 11/2002 Bravo et al. ..... 5/425
6,578,218 B2 6/2003 Wassilefsky
6,634,045 B1 10/2003 DuDonis
6,708,353 B2 * 3/2004 Han ..... 5/632
6,804,845 B2 * 10/2004 Stewart, III et al. ..... 5/632
6,848,130 B1 * 2/2005 Wilson ..... 5/425
6,877,176 B2 * 4/2005 Houghteling ..... 5/655
2002/0042954 A1 * 4/2002 Straub ..... 5/655
2003/0033673 A1 * 2/2003 Cuadra ..... 5/632
2003/0079289 A1 * 5/2003 Vrzalik ..... 5/618
2004/0060117 A1 * 4/2004 Chan ..... 5/655
2004/0123392 A1 * 7/2004 Stewart, III et al. ..... 5/632
2004/0172763 A1 * 9/2004 Sachs et al. ..... 5/656
2005/0076444 A2 * 4/2005 Houghteling ..... 5/655
2005/0101896 A1 * 5/2005 Calabrese ..... 602/18

* cited by examiner

METHOD OF REPOSITIONING IMMOBILE PATIENT IN BED USING PATIENT POSITIONING AID

CROSS-REFERENCE TO RELATED APPLICATIONS

This application claims priority from provisional application Ser. No. 60/485,584, filed Jul. 8, 2003.

STATEMENT REGARDING FEDERALLY SPONSORED RESEARCH OR DEVELOPMENT

Not Applicable.

REFERENCE TO A "MICROFICHE APPENDIX."

Not Applicable.

BACKGROUND OF THE INVENTION

1. Field of the Invention

This invention pertains to cushions used to support patients in bed.

2. Description of Related Art including Information Disclosed under 37 CFR 1.97 and 37 CFR 1.98.

"Immobile" patients are those who are confined to bed. Such immobile patients do not have a tendency to change their position in bed voluntarily. It is therefore desirable for caregivers to manually turn patients in bed on a prescribed schedule (often every two hours) to avoid complications such as pressure ulcers, pneumonia and other related infections that arise from excessive time in a supine position. Published guidelines recommend turning patients 30° when in the lateral inclined position.

Bariatric patients are those patients who are morbidly obese, that is, have a Body Mass Index of 40 kg/m2 or are 45.5 kg (100 pounds) or more overweight The immobile bariatric patient population has special needs for a lateral turning and positioning device due to the tendency of the positioning devices to migrate away or "pop out" from behind the patient while in use. There also is a tendency by the bariatric patient to crush positioning devices due to the imposed heavy weight. Immobile bariatric patients also present challenges to caregivers with the tasks of frequent rotation or other manipulation of such patients.

A number of cushion devices have been described to aid in the maintenance of patients in desired positions on a bed.

U.S. Pat. No. 3,389,411 discloses a foam wedge with a cover having a trapezoidal opening on the bottom which exposes the foam. The foam has highly frictional characteristics which retard slippage of the wedge on the bed.

U.S. Pat. No. 3,811,140 discloses a body support device comprising two wedges which are attached by belts and are oriented along the length of the bed. This device is intended for maintaining alignment while in the supine position and relieving pressure from the bony prominences of the spine.

U.S. Pat. No. 3,842,977 discloses a pillow-enclosing casing in which a pillow, particularly a foam pillow, is rolled and reduced in volume and then inserted into a tubular casing.

U.S. Pat. No. 3,938,205 discloses a body positioner which extends from the neck to the thigh for use on an examination table. The positioner is made of elongated resilient deformable polyurethane foam and has three major surfaces and three minor surfaces.

U.S. Pat. No. 4,045,204 discloses a compressed foam article which is compressed and packaged by enclosure in a substantially air-tight sack and a vacuum is drawn in the sack.

U.S. Pat. No. 4,214,326 discloses a body positioner and protection apparatus similar to the above disclosure which also has a removable center portion for covering the side frame to protect the patient.

U.S. Pat. No. 4,233,700 discloses a similar body positioner with cut outs for providing ventilation to portions of the patient's body.

U.S. Pat. No. 4,711,067 discloses a method packaging a mattress to a small size, in which the mattress is squeezed by compression means which drive the air from mattress and is then placed in a closed container or case.

U.S. Pat. No. 5,095,569 discloses a cover sheet secured by hook and loop type fasteners on straps to the upper surface of a wedge shaped polyurethane foam pillow with primary and secondary air passageways to facilitate breathing by users.

U.S. Pat. No. 5,359,739 discloses a patient repositioning and position maintenance device with cushioned cylinders which maintain the patient in position. The cylinders are retained on a rectangular fabric sheet with two pockets for the cylinders. A triangular knee wedge is attached to the fabric sheet by hook and loop fasteners.

U.S. Pat. No. 5,878,551 discloses a method of packaging a foam pet industry product which involves placing the foam product inside a plastic bag, reducing the pressure to remove air from the bag, and sealing the bag.

U.S. Pat. No. 6,154,900 discloses a patient turning device which uses air pressure in bladders to laterally rotate a patient. The patient is supported from head to calf.

U.S. Pat. No. 6,292,964 discloses an inclined support pillow formed of two layers with additional hemi-cylindrical cushions which are attached by hook and loop fasteners.

U.S. Pat. No. 6,360,387 discloses a fertility cushion with a convex front having a removable cover attached by hook and loop strips. The multiple-foam construction of the cushion is disclosed.

U.S. Pat. No. 6,578,218 discloses a leg spacer pillow comprising two hinged portions with a butterfly shape and hook and loop fasteners to hold the pillow in the closed position.

U.S. Pat. No. 6,634,045, incorporated herein by reference, discloses a heel elevator support.

None of the discovered prior art disclosures provide the advantages of embodiments of the present invention. They provide a cushion constructed of microbiologically-resistant foam with a relatively strong and resilient core foam and a relatively yielding surface foam. Embodiments of the cushions have a general triangular wedge shape with the front and back surfaces convex. Embodiments have covers with friction and shear reducing properties on the patient sides and on the caregiver sides and nonslip properties on the bottoms, and with straps on the care provider sides to aid in manipulating the cushions.

BRIEF SUMMARY OF THE EMBODIMENTS OF THE INVENTION

This invention is a patient positioning aid comprising, a generally wedge-shaped multisided polymeric foam cushion, the cushion having the general shape of a solid with a polygonal, hemispheric or circular cross section, a length which approximates the length of a patient's torso, a height adequate to prevent the rolling of a patient, and two ends, the cushion having a caregivers panel, a patient panel having a convex shape in cross-section, and a bottom panel, the cushion comprised of a strong, resilient, high modulus of elasticity, inner core foam, an outer layer foam of soft, compliant, viscoelastic foam, and a cover comprised of a moisture proof low friction and shear reducing material, the cover having a high friction surface on the bottom panel.

Embodiments of this invention are patient positioning aids comprising, a generally wedge-shaped multisided foam cushion with a cover. Embodiments of the cushion have a polygonal, hemispheric, or circular cross section, a cushion length which approximates the length of a patient's torso, and two ends. Embodiments of the cushion have a caregiver panel, a patient panel with a convex shape in cross-section, and a bottom panel which is generally straight in cross section. Embodiments of the cushions are comprised of a strong, resilient, high modulus, inner core polyurethane or copolymer foam coated with an outer layer of soft compliant viscoelastic foam. The preferred outer layer foam is a viscoelastic or low IFD foam. Embodiments of the cushions have a cover comprised of a moisture proof low friction and shear reducing fabric material covering the upper surfaces of a cushion on the patient and caregiver contact sides. A high friction slip resistant surface is on the bottom panel. In some embodiments manipulation devices on the caregiver sides facilitate maneuvering of the aid in positioning it against the patient.

One objective of embodiments of this invention is to provide an effective aid for positioning immobile patients in a laterally elevated position.

Another objective of embodiments of this invention is to aid in positioning immobile bariatric patients in a laterally elevated position.

Another objective of embodiments of this invention is to provide a positioning aid which resists crushing by a laterally elevated patient.

Another objective of embodiments of this invention is to provide a patient positioning aid with a soft outer layer to prevent injury to a patient's skin.

Another objective of embodiments of this invention is to provide a patient positioning aid with a cushion comprising antimicrobials.

Another objective of embodiments of this invention is to provide a positioning aid with a waterproof cover which may be removed or wiped down for cleaning.

Another objective of embodiments of this invention is to provide a positioning aid with a slip-resistant coating or fabric on the bottom side of the cover which resists movement of the positioning aid on the surface of the bed so the patient maintains proper elevation and positioning throughout the full turning schedule.

Another objective of embodiments of this invention is to provide a positioning aid with manipulation devices to assist the caregiver in the proper orienting of the positioning aid under the patient.

A final objective of embodiments of this invention is to provide a positioning aid which may be manufactured easily and inexpensively without adverse effects on the environment.

DETAILED DESCRIPTION OF THE EMBODIMENTS OF THE INVENTION

"Immobile" patients are those who are confined to bed. Such immobile patients do not have a tendency to change their position in bed voluntarily. It is therefore desirable for caregivers to manually turn patients in bed on a prescribed schedule (often every two hours) to avoid complications such as pressure ulcers, pneumonia and other related infections that arise from excessive time in a supine position. Published guidelines recommend turning patients 30° when in the lateral inclined position.

Two key benefits flow from the regular rotation of immobile patients:

1. Pressure points are shifted from one lateral side of the body to another, which promotes good circulation and avoids damage to the skin over bony prominences, such as the sacrum, coccyx, and trochanter, resulting in pressure ulcers.

2. Fluid is not permitted to settle and stagnate in the lungs, which can lead to pulmonary complications such as pneumonia.

Bariatric patients are those patients who are morbidly obese, that is, have a Body Mass Index of 40 kg/m$^2$ or are 45.5 kg (100 pounds) or more overweight. The immobile bariatric patient population has special needs for a lateral turning and positioning device due to the tendency of the patients to crush positioning devices or pillows due to the heavy weight imposed on positioning devices or pillows. Immobile bariatric patients also present challenges to caregivers with the tasks of frequent rotation, repositioning, or other manipulation of such patients. In fact, manipulation and assistance of bariatric patients is a frequent source of occupational injuries for caregivers.

Figure 1:
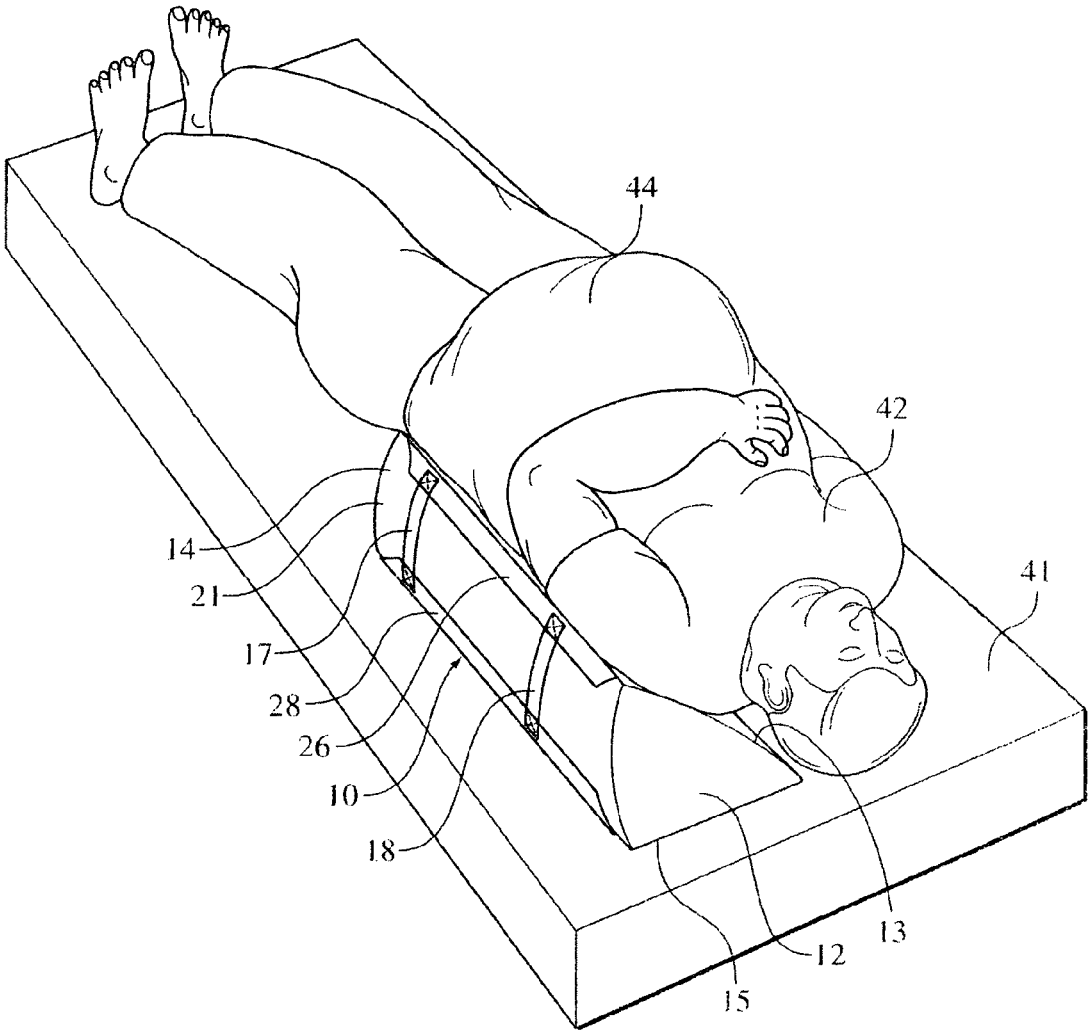
FIG. 1 is a perspective view of the first embodiment positioning aid in use.

Rolled pillows or blankets are the most common positioning devices conventionally used. These improvisations are placed or shoved under the side of the body the caregiver wishes to elevate. Unfortunately, these pillows or blankets tend to compress under the weight of the immobile patient, or tend to slide away from the patient's body. In either case the desired effect in maintaining the patient in the desired position is lost. The patient then assumes the supine back-lying position with the risk of pressure ulcers and fluid in the lungs. All of the deficiencies of using rolled pillows or blankets as positional aids are magnified in the case of bariatric patients FIG. 1 is a perspective view of the first embodiment positioning aid in use. Visible in FIG. 1 is a bed 41, a patient 42, and a first embodiment positioning aid 10. The positioning aid is shown being used to support the immobile patient in a desired position on the bed. Elements of the first embodiment positioning aid visible in FIG. 1 included the patient panel 13, caregiver panel 14, right end panel 12, bottom panel 15, upper flap 26, lower flap 28, left strap 17, right strap 18, and positioning aid cover 21. The length of the positioning aid from right end panel 12 to left end panel (not visible in FIG. 1) approximates the length of a patient's torso 44, from about 61 to 92 cm (24 to 36 inches). The surface of the patient's panel has a concave shape and the highest portion of the positioning aid extends above the bed about 30 to 61 cm (12 to 24 inches).

Figure 2:
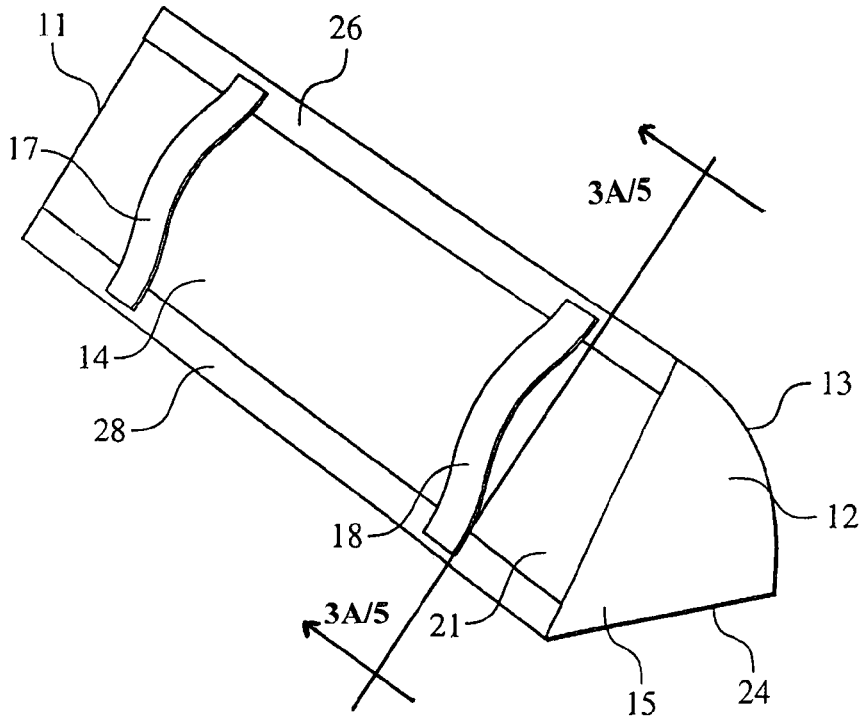
FIG. 2 is a perspective view of the first embodiment positioning aid.

FIG. 2 is a perspective view of the first embodiment positioning aid 10. Visible in FIG. 2 is the first embodiment cover 21 with patient panel 13, caregiver panel 14, right end panel 12, left handle 17, right handle 18, bottom panel 15, antislip material 24 on bottom of the bottom panel 15, and fastener 22 which closes the opening 23 which runs along the intersection of the caregiver panel 14 and bottom panel 15 from the right end panel 12 to the left end panel 11.

Figure 3A:
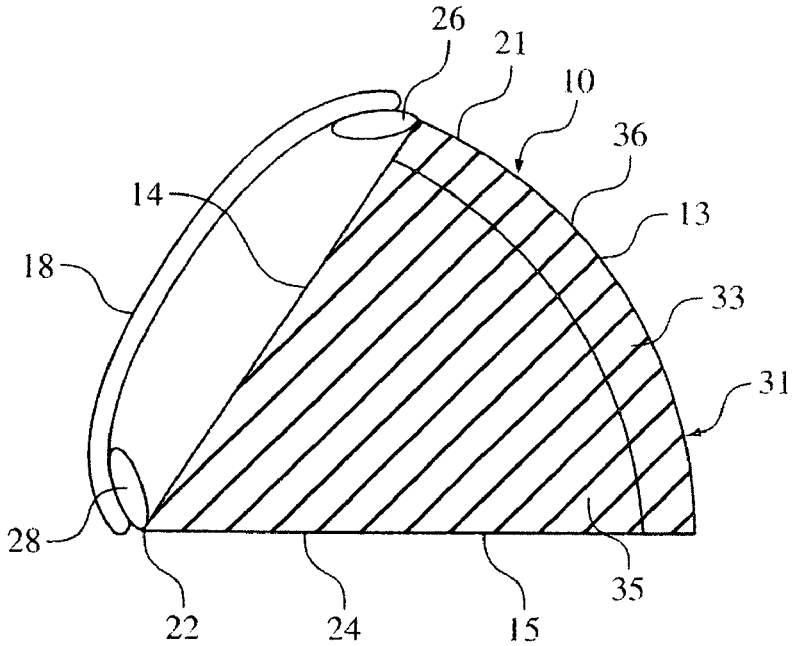
FIG. 3A is a cross section view of the first embodiment positioning aid taken along line 3A/5-3A/5 of FIG. 2.

FIG. 3A is a cross section view of the first embodiment positioning aid 10 taken along line 3-3 of FIG. 2. Visible in FIG. 3A is the foam cushion 31 which is a polygon with 3 sides in cross section with a convex shaped patient's side 36, cover 21 with a patient's panel 13, bottom panel 15, antislip material 24 on the bottom of bottom panel 15, caregiver's panel 14, and fastener 22. The right handle 18 is connected to the upper flap 26 and lower flap 28. The foam cushion 31 is comprised of the resilient, relatively hard foam core 35 and viscoelastic relatively soft foam surface 33 located the patient side of the foam core.

Figure 3B:
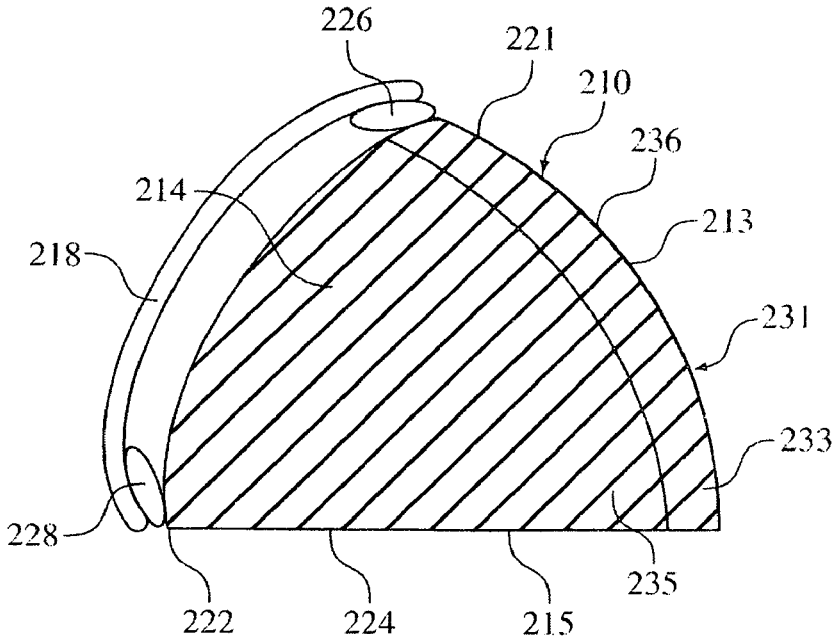
FIG. 3B is a cross section view of the second embodiment positioning aid.

FIG. 3B is a cross section view of the second embodiment positioning aid 210 taken as in FIG. 3A. The second embodiment is the same as the first embodiment except that the foam 231 on the caregiver's side 238 as well as on the patient's side 236 is convex so that the caregiver's panel 214 is convex in cross section. Visible in FIG. 3B is the foam cushion 231 which is a polygon with 3 sides in cross section with a convex shaped patient's side 236, cover 221 with a patient's panel 213, bottom panel 215, antislip material 224 on the bottom of bottom panel 215, caregiver panel 214 which is convex in shape, and fastener 222. The right handle 218 is connected to the upper flap 226 and lower flap 228. The foam cushion 231 is comprised of the resilient, relatively hard foam core 235 and viscoelastic relatively soft foam surface 233 located the patient side of the foam core 235.

Figure 5:
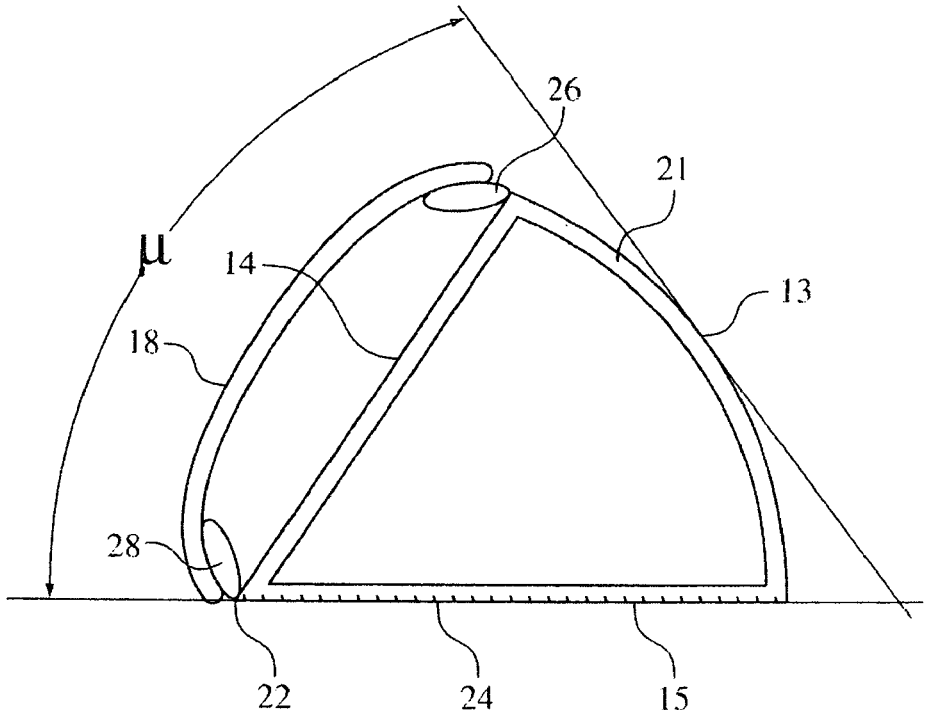
FIG. 5 is a cross section view of the cover of the first embodiment positioning aid taken along the line 3A/5-3A/5 of FIG. 2.

In the first and second embodiments of the positioning aid the angle formed by the bottom panel 15 and 215 and the patient's panel 13 and 215 is approximately 30°, $\alpha$ on FIG. 5. This allows the patient to be maintained at a lateral inclined position of approximately 30° as recommended by the National Pressure Ulcer Advisory panel. This angle is high enough to relieve pressure from the sacrum and coccyx yet not so high as to put pressure on the trochanter or other bony prominence at risk for development of pressure ulcers.

Figure 3C:
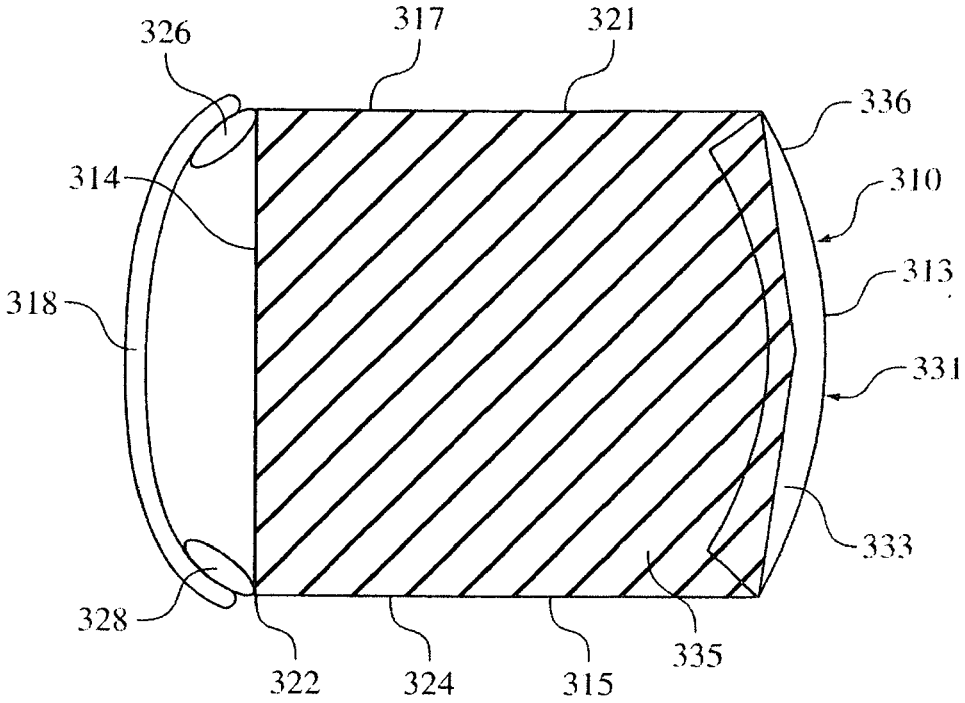
FIG. 3C is a cross section view of the third embodiment positioning aid.

FIG. 3C is a cross section view of the third embodiment positioning aid 310 taken as in FIG. 3A. The third embodiment is the same as the first embodiment except that the foam cushion 331 in cross section is a polygon with 4 sides and the patient's side 336 is convex in cross section. Visible in FIG. 3C is the foam cushion 331, with cover 321 with a convex patient panel 313, bottom panel 315, antislip material 324 on the bottom of bottom panel 315, caregiver panel 314, top panel 317, upper flap 326 and lower flap 328 to which is fastened the right handle 318, and fastener 322. The foam cushion 331 is comprised of the resilient, relatively hard foam core 335 and viscoelastic relatively soft foam surface 333 located the patient side of the foam core 335.

Figure 3D:
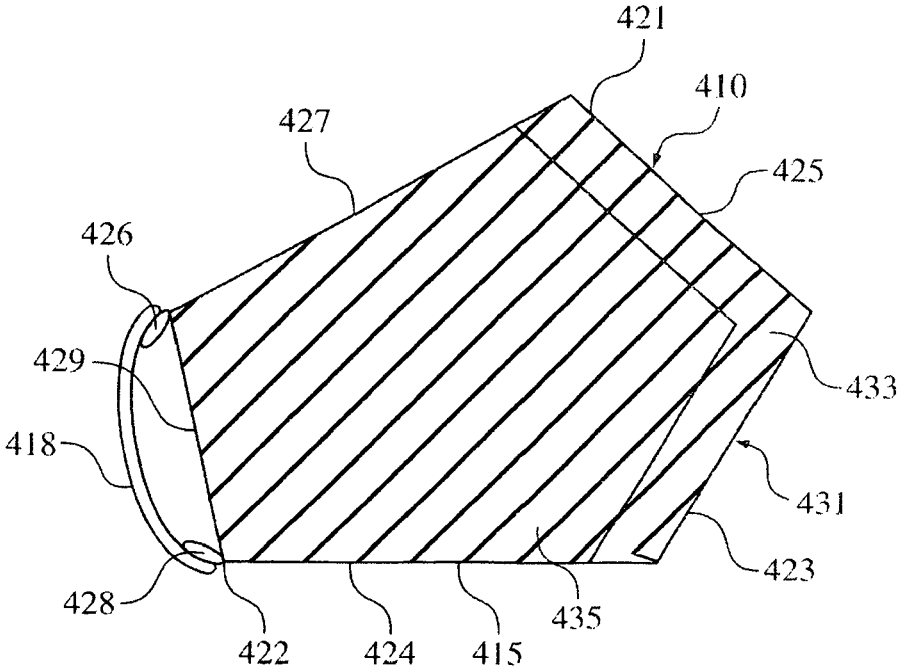
FIG. 3D is a cross section view of the fourth embodiment positioning aid.

FIG. 3D is a cross section view of the fourth embodiment positioning aid 410. The fourth embodiment is the same as the first embodiment except that the foam cushion 431 in cross section is a polygon with 5 sides. Visible in FIG. 3D is the foam cushion 431, with cover 421 with a upper patient's panel 425, bottom patient's panel 423, bottom panel 415, antislip material 424 on the bottom of bottom panel 415, upper caregiver's panel 427, lower caregiver's panel 429, upper flap 426 and lower flap 428 to which is fastened the right handle 418, and fastener 422. The foam cushion 431 is comprised of the resilient, relatively hard foam core 435 and viscoelastic relatively soft foam surface 433 located the patient side of the foam core 435.

Figure 3E:
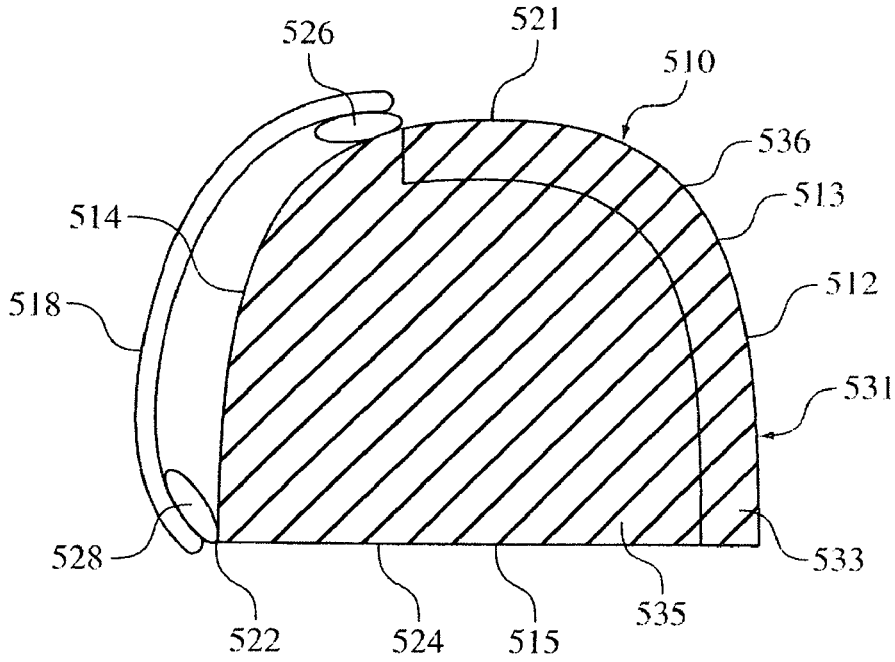
FIG. 3E is a cross section view of the fifth embodiment positioning aid.

FIG. 3E is a cross section view of the fifth embodiment positioning aid 510. The fifth embodiment is the same as the first embodiment except that the foam cushion 531 in cross section is a hemisphere 536 with a flat bottom side. Visible in FIG. 3E is the foam cushion 531, with cover 521 with a hemispheric panel 512 which extends from one side of the bottom panel 515 to the other and which includes the patient panel 513 and caregiver panel 514. Also visible is the bottom panel 515, antislip material 524 on the bottom of bottom panel 515, upper flap 526 and lower flap 528 to which is fastened the right handle 518, and fastener 522. Note that the hemispheric shape of the fifth embodiment positioning aid in cross section provides a convex shape to both the patient panel 513 and the caregiver panel 514 portions of the positioning aid. The foam cushion 531 is comprised of the resilient, relatively hard foam core 535 and viscoelastic relatively soft foam surface 533 located the patient side of the foam core 535.

Figure 3F:
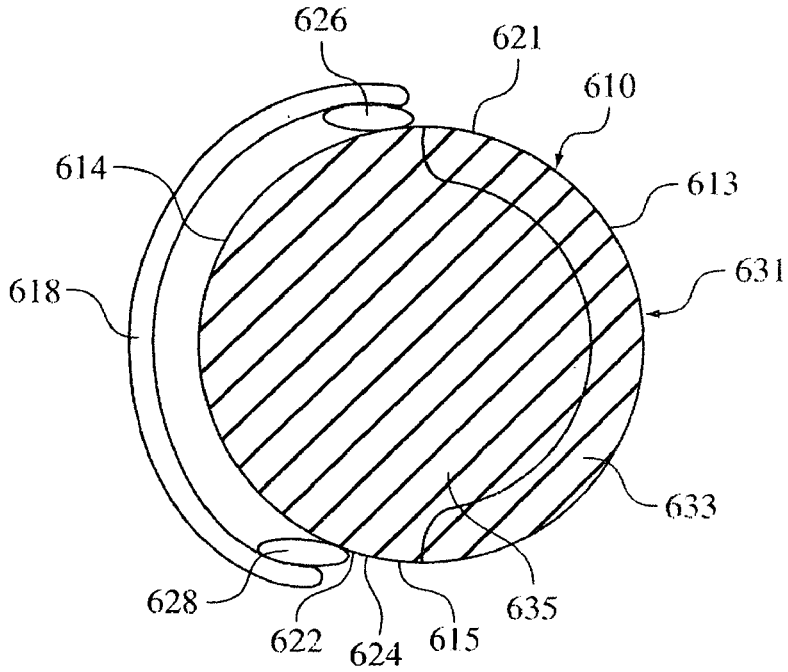
FIG. 3F is a cross section view of the sixth embodiment positioning aid.

FIG. 3F is a cross section view of the sixth embodiment positioning aid 610. The sixth embodiment is the same as the first embodiment except that the foam 631 in cross section has a circle shape. Visible in FIG. 3F is the foam cushion 631, with cover 621. In cross section the patient panel 613 is circular in shape as is the caregiver panel 614 and the bottom 615. Also visible in FIG. 3F is the nonslip material 624 on the bottom of the bottom panel 615, the upper flap 626 and lower flap 628 to which is fastened the right handle 618 and the fastener 622. The foam cushion 631 is comprised of the resilient, relatively hard foam core 635 and viscoelastic relatively soft foam surface 633 located the patient side of the foam core 635.

Figure 4A:
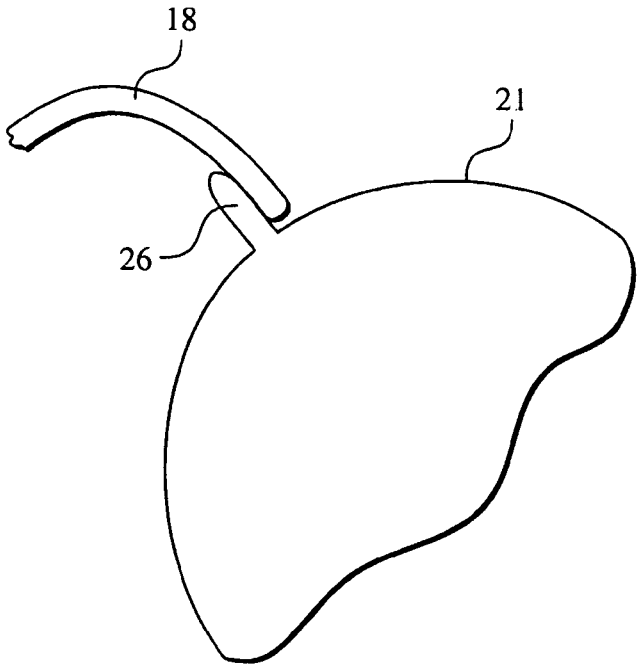
FIG. 4A is a cross section of the attachment site for the handles of the first embodiment positioning aid.

FIG. 4A is a cross section view of the cover of embodiment 1 showing the upper flap and handle. Visible in FIG. 4A is the cover 21, upper flap 26, and right handle 18. The upper and lower flaps are formed from a folded over portion of the cover. The flap is maintained by attaching the two sides of the flap together, in a preferred case in which the cover has a polyurethane lining, by fusing together the polyurethane surfaces of the cover. The handle is attached to the flap, in a preferred case, by stitching. Other attachment methods such as rivets, snaps, buttons, or the like may also be used.

Figure 4B:
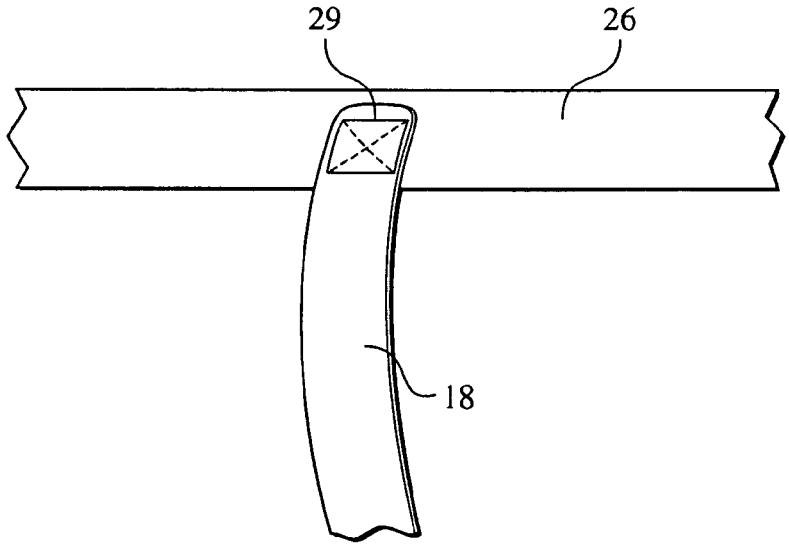
FIG. 4B shows details of the connection of a handle to the upper fold.

FIG. 4B shows details of attachment of the handle 18 to the upper flap 16 by stitching 29.

FIG. 5 is a cross section view of the cover 21 of the first embodiment positioning aid taken along the line 3A/5-3A/5 of FIG. 2. Visible in FIG. 5 is the patient panel 13, caregiver panel 14, bottom panel 15, nonslip material 24 on the bottom of bottom panel 15, upper flap 26 and lower flap 28 to which is attached the right handle 18, and fastener 22.

Figure 6:
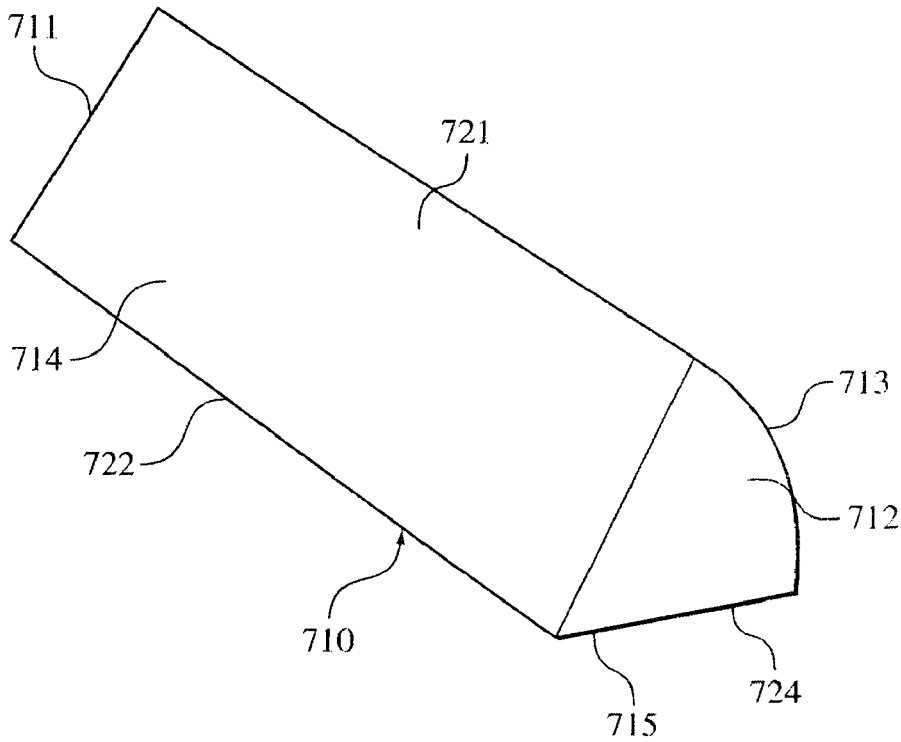
FIG. 6 is a perspective view of the seventh embodiment positioning aid.

FIG. 6 is a perspective view of the seventh embodiment positioning aid 710. This eighth embodiment is the same as the first embodiment positioning aid except the seventh embodiment cover has no flaps and no handles. The seventh embodiment cover avoids any chance of injury to the patient from rolling over and lying on or being entangled with the handles. On the other hand, the seventh embodiment cover positioning aid does not provide handholds which aid the caregiver in manipulating the positioning aid. Visible in FIG. 6 is the cover 721 with patient panel 713, right end panel 712, caregiver panel 714, bottom panel 715, antislip material 724 on bottom of bottom panel 715, and fastener 722 which runs along the intersection of the caregiver panel 713 and bottom panel 714 from the right end panel 712 to the left end panel 711 (not visible in FIG. 6).

Figure 7:
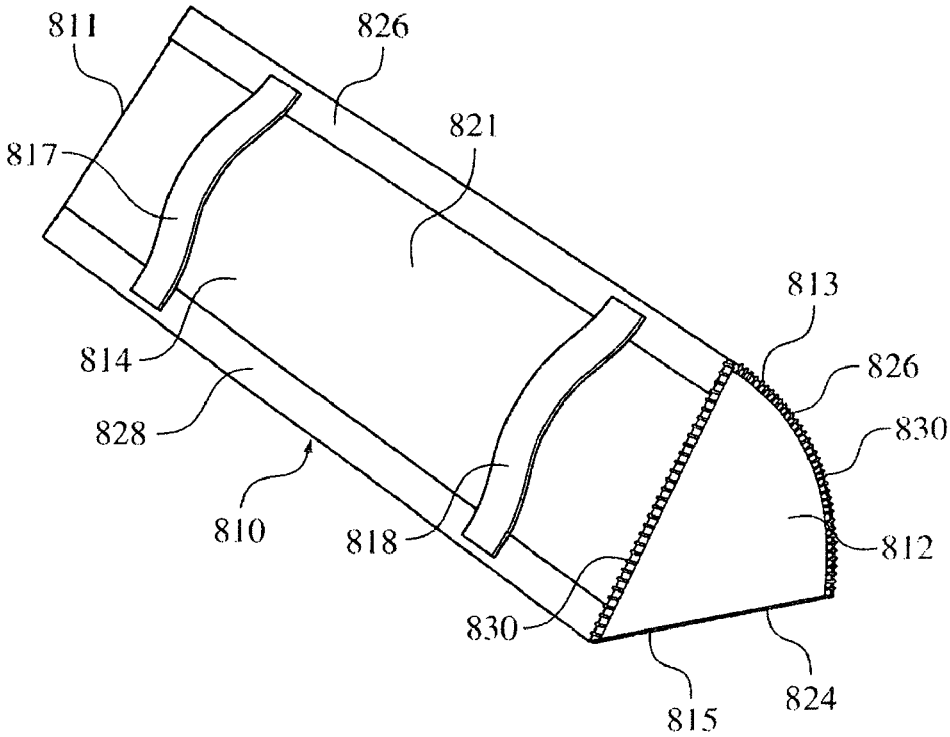
FIG. 7 is a perspective view of the eighth embodiment positioning aid.

FIG. 7 is a perspective view of the eighth embodiment positioning aid 810. This eighth embodiment is the same as the first embodiment positioning aid except the eighth embodiment cover 821 has an openable right end panel 812 which is secured by fastener 826 which runs around one edge of the caregiver panel 814 and the patient panel 813. The right end panel swings down as a flap attached to the bottom panel 815 to allow insertion and removal of the foam cushion. Also visible in FIG. 7 is the cover 821 with patient panel 813, antislip material 824 on bottom of bottom panel 815, upper flap 826 and bottom flap 828 to which are attached left handle 817 and right handle 818, and left end panel 811 (not visible in FIG. 7).

Figure 8:
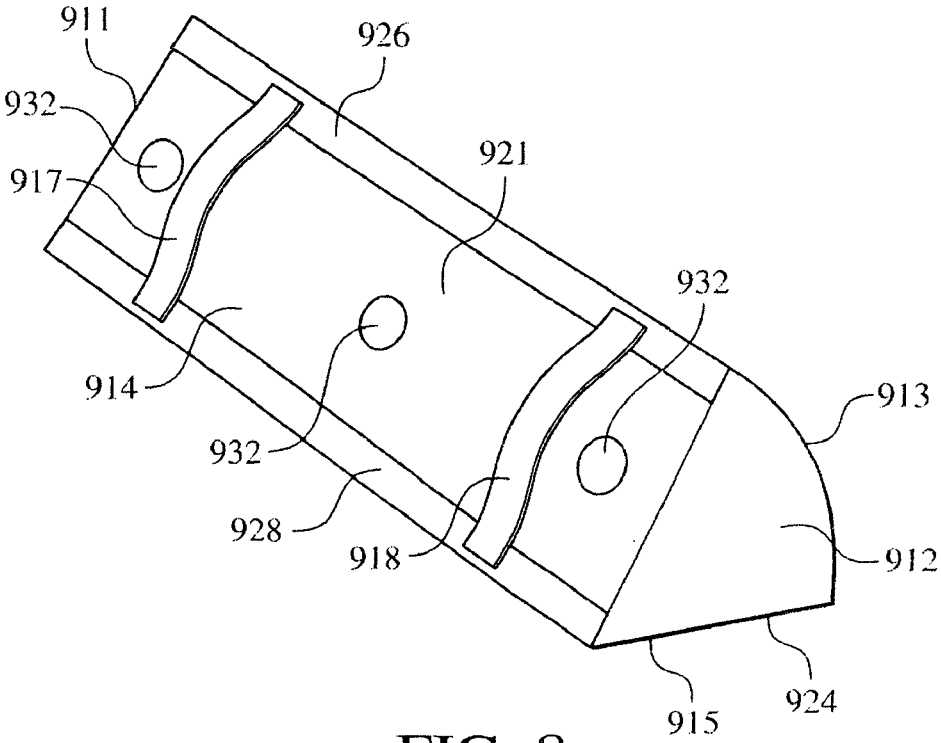
FIG. 8 is a perspective view of the ninth embodiment positioning aid.

FIG. 8 is a perspective view of the ninth embodiment positioning aid 910. The ninth embodiment is the same as the first embodiment positioning aid except the ninth embodiment positioning aid is constructed with a non-removable cover 921 and is intended for use by a single patient. The ninth embodiment positioning aid 90 is discarded or recycled after use by a single patient. In addition, the ninth embodiment positioning aid cover has holes which allow the escape of air from the inside of the cover. Any embodiment positioning aid may be constructed using the materials for the cover and methods of construction used with the ninth embodiment positioning aid. The ninth embodiment cover 921 is comprised of water-resistant elastomer material. A preferred material is thermoplastic polyurethane film manufactured by J.P. Stevens Elastomerics of Holyoke, Massachusetts. The ninth embodiment cover panels preferably are attached to each other by radio frequency (RE) welding along the seams connecting the side panels and the end panels. A ninth embodiment positioning aid is constructed by first shaping the cushion, then applying cover panels, then welding the panels together by radio frequency welding, or by insertion of a cushion into a cover with the panels partially attached to each other, then fastening the remaining panels. Other suitable methods for attaching the panels together, such as sewing, heat sealing, or gluing with permanent adhesives, such as epoxy adhesives, may be used.

Visible in FIG. 8 is the ninth embodiment cover 921 with patient panel 913, right end panel 912, upper flap 926 and lower flap 928 with attached right handle 918 and left handle 917, caregiver panel 914, bottom panel 915, antislip material 924 on bottom of bottom panel 915, and fastener 922 which runs along the intersection of the patient panel 913 and caregiver panel 914 from the right end panel 912 to the left end panel 911 (not visible in FIG. 8) and holes 932 which allow air to enter and leave the ninth embodiment positioning aid.

Figure 9:
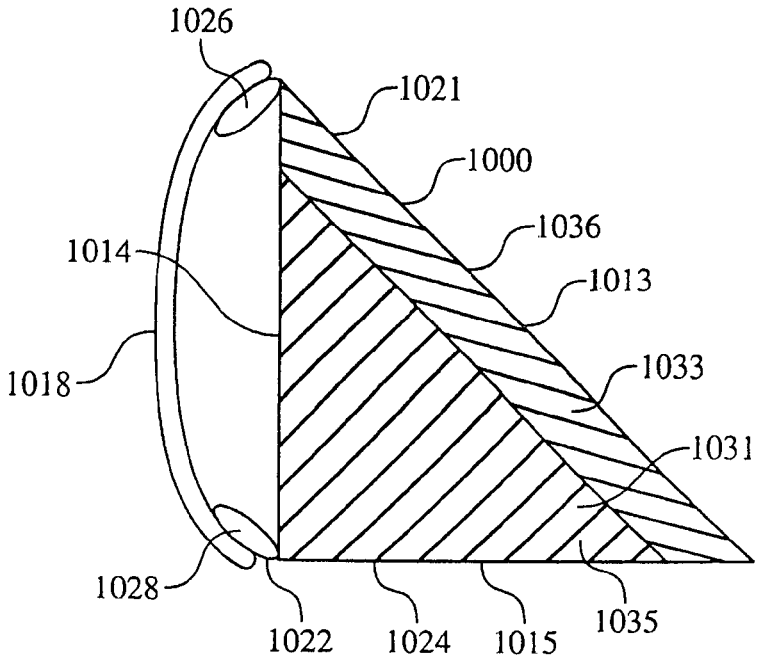
FIG. 9 is a cross section of the tenth embodiment positioning aid.

FIG. 9 is a cross section of the tenth embodiment positioning aid taken as in FIG. 3A. The tenth embodiment 1010 is the same as the first embodiment positioning aid except in the tenth embodiment aid the patient's side of the foam cushion is flat. Visible in FIG. 9 is the foam cushion 1031 which is in cross section a polygon with 3 sides with a flat patient's side, cover 1021 with a patient's panel 1013, bottom panel 1015, antislip material 1024 on the bottom of bottom panel 1015, caregiver's panel 1014, and fastener 1022. The foam cushion 1031 is comprised of the resilient, relatively hard foam core 1035 and viscoelastic relatively soft foam surface 1033 located on the patient side of the foam core.

Since the patient side of the tenth embodiment is flat rather than convex, the tenth embodiment aid is more apt to be displaced by the patient than the other embodiments. This disadvantage, however, is countered by the relative ease and economy of manufacture, and associated reduction in cost, of the tenth embodiment.

In the disclosed embodiments, the cushion is comprised of a relatively high resilience and relatively firmer internal core foam. In a preferred embodiment the cushion material is hypo-allegenic and latex-free. The inner core resists compression by the patient's weight. An outer foam layer which is relatively soft and viscoelastic is attached to the patient side of the inner foam. The outer layer is soft and yielding, and does not injure the patient's skin. The outer layer is attached to the inner core by adhesive, preferably polyurethane adhesive.

In the disclosed embodiments, the inner core foam may be comprised of any suitable foam material, such as polyurethane foam, copolymer foam, or latex foam. A preferred foam is polyurethane foam. The preferred foam is available in several variations, such a 1A high resiliency and HD high density which has very high density. Latex foam is less preferred because of the chance of incurring allergic reactions to the foam. The foam density range is from 1.4 to 4.6 pounds per cubic foot. The firmness of foam is measured by indention force deflection (IFD). A preferred foam has an IFD of 30 to 80.

The outer layer foam may be comprised of the same materials as the inner core foam except that it is of lower density and lower resilience. The outer layer foam is a pressure reducing grade of foam that is not less than 1.2 pounds per cubic foot in density and has a maximum of 30 IFD. Preferably the outer layer foam is viscoelastic, that is, has appreciable and conjoint viscous and elastic properties. Viscoelastic foam tends to be more dense than other polyurethane foam.

In a preferred foam an antimicrobial additive is included in the foam. One preferred antimicrobial is VINYZENE antimicrobial additive for plastics, a trademark for solutions of 10,10'-oxybisphenoxarsine owned by Rohm and Hans, Philadelphia, Pa.

The cover of the first through eighth and tenth embodiments is removable for cleaning. A preferred material is 70 denier nylon taffeta manufactured by Stafford Textiles of Toronto, Ontario, Canada. Other suitable fabric materials may be used, such vinyl and rayon may be used. The fabric material is coated, preferably on the bottom, with a suitable water-resistant polymer such as polyurethane, butyl rubber, vinyl, latex, and thermoplastic urethane. A preferred coating includes polycast coat laminate and STAPH CHECK medical grade vinyl. STAPH CHECK is a trademark owned by Herculite Products of Emigsville, Pa.

In the first through eighth and tenth embodiments, the cover has an opening through which the cushion is inserted. The cover may be removed for cleaning. In some embodiments the opening extends along the intersection between the sides of the cover from one end to the other. In another embodiment, the opening extends around the intersection between the panels and one end panel, allowing the end panel to be swung open as a flap. In the first through eighth embodiments the opening is closed by suitable fasteners which securely hold the opening closed when desired yet do not injure the skin of the patient. A preferred fastener is a zipper. Other suitable fasteners include hood and loop fabric fasteners, buttons and snaps. The fastener may be covered by a flap of fabric running along the opening.

The first through eighth and tenth embodiments cover panels are attached to each other by sewing along the seams. The first through eighth and tenth embodiments positioning aid is constructed by first shaping the cushion, assembling the cover by sewing together the cover panels, inserting the cushion into the cover through the opening defined by the fastener, and closing the opening using the fastener. Other suitable methods for attaching the panels together, such as radio frequency welding, heat sealing, or gluing with permanent adhesives, such as epoxy adhesives, may be used.

The handles in the first through sixth and eighth through tenth embodiment covers are in the form of straps which extend from the top to the bottom of the caregiver panel. Any other suitable handles which allow the caregiver a purchase on the positioning aid when manipulating the positioning aid, and which is soft and yielding, and therefore unlikely to injure the skin of the patient, may be used. For example, a strap which extends from one end panel to the other end panel on the caregiver's side may be used. The handles preferably are of a color distinct from that of the rest of the positioning aid to assist the caregiver in orienting the aid for use.

In the embodiments, the interior side of the cover, that is, the side facing the cushion, preferably is treated to make it waterproof, for example, coated with polyurethane or butyl rubber.

In the embodiments, the upper sides of the cover, that is, the side to which the patient is exposed, are made of friction and shear reducing fabrics, such as nylon or polyurethane fabrics. The use of friction and shear reducing fabrics alleviates and minimizes trauma to the skin of the patient.

In the embodiments, a variety of materials may be used as the non-slip coating applied to the side of the bottom panel which makes contact with the sheet and mattress of the patient positioning aid cover. Any durable suitable material which provides a slip-resistant or non-slip effect which prevents and retards the sliding of the positioning aid on the surface of the bedsheet may be used. A preferred material is the no-slip material sold under the trademark SOFTGRIP BLUE # 2915C coating which is available from Ventrex, Inc., Great Falls, Va. Other suitable materials include ANTI-SLIP GRIP TAPES, tapes having an antislip surface and self-adhesive backing and are available from ALL-TAPES.COM, Chatsworth, Calif. Suitable antislip materials include 3M SAFETY WALK trademark general purpose tapes & treads 600 Series products available from Martinson-Nicholls, Inc., Willoughby, Ohio. Other suitable non-slip materials include NAMCO vinyl backing mats and nitrile rubber gripper backing available from North American Mat Company, Holleandale, Minn.

Although the ninth embodiment positioning aid has been described using the first embodiment positioning aid structure with a disposable cover, the cover of the ninth embodiment may be used with the structure of any of the embodiments.

It is desirable that embodiments of the positioning aid be capable of reduction in volume during shipping, storage, and generally when not in use. The relatively large volume of the positioning aids places severe burdens on the storage facilities of hospitals and nursing facilities when the aids are stored. This burden is especially high with disposable ninth embodiment positioning aids which have high inventory requirements.

The volume problem is alleviated by reducing the volume of packaged positioning aids. In this process, the positioning aid is first compressed and reduced in volume to not more than 15% of freely expanded volume and the compressed positioning aid is then packaged by tightly wrapping with a suitably strong material, such as plastic film or fabric straps. In an alternative process the compressed positioning aid is placed into a cylindrical cover which is manufactured of a suitable strong material such as plastic film or fabric. Removal of the packing material or the cylindrical cover allows the positioning aid to resume a freely expanded volume and be ready for use.

In a second method of packing positioning aids, the first through eighth embodiment positioning aid cushion without a cover is compressed and reduced in volume to not more than 15% of freely expanded volume and the compressed positioning aid is then packaged by tightly wrapping with a suitably strong material, such as plastic film or fabric straps. In an alternative process the compressed positioning aid is placed into a cylindrical cover which is manufactured of a suitable strong material such as plastic film or fabric. To prepare the positioning aid for use, the packing material or cover is removed, the cushion is allowed to resume the freely expanded volume, and a first through eighth embodiment cover is placed over the cushion, thus providing a complete positioning aid ready for use.

It will be apparent to those skilled in the art that the examples and embodiments described herein are by way of illustration and not of limitation, and that other examples may be used without departing from the spirit and scope of the present invention, as set forth in the appended claims.

I claim:

1. The method of lateral turning and repositioning of patients in bed and the prevention and treatment of pressure ulcers, pneumonia and other hazards of immobility in a patient comprising the steps of:

a. turning the patient 30° in the lateral inclined position in the bed, and b. supporting the patient in the desired turned position with a patient positioning aid comprising:

a generally wedge-shaped multisided polymeric foam cushion having a length which approximates the length of a patient's torso, and a height adequate to prevent the rolling of a patient, the cushion having a caretaker panel, a flat or convex patient panel, and a flat bottom panel, the angle between the patient panel and the bottom panel being approximately 30°, the cushion comprised of an inner core of a strong, resilient, high modulus of elasticity foam having a density of 1.4-4.6 pounds per cubic foot and an indention force deflection of 30-80 and an outer layer of soft, compliant, viscoelastic foam having a density of not less than 1.2 pounds per cubic foot and an indention force deflection equal to or less than 30, and the cushion having a cover comprised of a moisture proof low friction and shear reducing material, the cover having a high friction polyurethane, butyl rubber, or vinyl coating on the portion of the cover covering the bottom panel of the cushion.

* * * * *